US010579018B2

(12) United States Patent
Von Allmen et al.

(10) Patent No.: US 10,579,018 B2
(45) Date of Patent: Mar. 3, 2020

(54) TIMEPIECE WITH DIGITAL TIME DISPLAY

(71) Applicant: Richemont International S.A., Villas-sur-Glane (CH)

(72) Inventors: Michael Von Allmen, Zurich (CH); Gudrun Kerstin Lesske, Singen-Hohentwiel (DE)

(73) Assignee: Richemont International S.A., Villars-sur-Glane (CH)

( * ) Notice: Subject to any disclaimer, the term of this patent is extended or adjusted under 35 U.S.C. 154(b) by 172 days.

(21) Appl. No.: 15/942,125

(22) Filed: Mar. 30, 2018

(65) Prior Publication Data

US 2018/0284697 A1 Oct. 4, 2018

(30) Foreign Application Priority Data

Mar. 30, 2017 (CH) ..... 0425/17

(51) Int. Cl.
*G04B 19/20* (2006.01)
*G04B 15/14* (2006.01)
(Continued)

(52) U.S. Cl.
CPC ..... *G04B 19/202* (2013.01); *G04B 13/00* (2013.01); *G04B 13/003* (2013.01); *G04B 15/14* (2013.01); *G04B 17/06* (2013.01)

(58) Field of Classification Search
CPC ..... G04B 19/20; G04B 15/14; G04B 13/00; G04B 13/003; G04B 17/06; G04B 19/202
See application file for complete search history.

(56) References Cited

U.S. PATENT DOCUMENTS 3,559,395 A 2/1971 Kikuchi
3,982,388 A 9/1976 Guyot et al.
(Continued)

FOREIGN PATENT DOCUMENTS

CH 164893 A 10/1933
CH 511 471 A 4/1971
(Continued)

OTHER PUBLICATIONS

Pallweber, J., "Patents for Inventions, Abridgements of Specifications, Class Watches," Great Britain Patent Office, p. 80-81 (Dec. 32, 1894).

(Continued)

*Primary Examiner* — Sean Kayes
(74) *Attorney, Agent, or Firm* — Christensen, Fonder, Dardi & Herbert PLLC

(57) ABSTRACT

A wristwatch with a gear train for rotatably advancing in cyclic steps a minute-units disk, a switching device for advancing a minute-tens disk and an hour ring which is advanced during one revolution of the minute-tens disk. The movement comprises a first and a second transmission chain connected to a release mechanism; the first transmission chain controls the second such that the second transmission chain transmits every minute a rotational movement force to a minute-units wheel. The release mechanism comprises a control disk, two release levers, each having a first and a second lever arm, and a release wheel. After each minute, a first lever arm falls from the control disk edge into a recess of the control disk and a second lever arm releases the release wheel, such that the second transmission chain rotates freely, allowing the minute-units disk to rotate one digit further.

14 Claims, 14 Drawing Sheets

(51) Int. Cl.
*G04B 13/00* (2006.01)
*G04B 17/06* (2006.01)

(56) References Cited

U.S. PATENT DOCUMENTS

| | | | | |
|---|---|---|---|---|
| 7,532,546 | B2 * | 5/2009 | Suzuki | G04B 19/253 368/28 |
| 8,038,340 | B2 | 10/2011 | Schneider | |
| 8,406,087 | B2 * | 3/2013 | Schneider | G04B 19/202 368/221 |
| 8,550,700 | B2 * | 10/2013 | Wiederrecht | G04B 1/225 368/186 |
| 8,750,080 | B2 * | 6/2014 | Tran | G04B 19/25 368/220 |
| 2006/0215498 | A1 | 9/2006 | Meier | |
| 2009/0067296 | A1 | 3/2009 | Schneider | |
| 2011/0090768 | A1 | 4/2011 | Schneider | |
| 2016/0170374 | A1 | 6/2016 | Monferrer et al. | |

FOREIGN PATENT DOCUMENTS

| | | | |
|---|---|---|---|
| CH | 581 857 | B5 | 11/1976 |
| CH | 710 463 | A2 | 6/2016 |
| DE | 25042 | C | 5/1883 |
| DE | 10 2007 042 797 | B4 | 4/2010 |
| DE | 10 2009 019 335 | B4 | 1/2011 |
| EP | 1 498 788 | A1 | 1/2005 |
| EP | 2 443 525 | B1 | 8/2013 |
| EP | 3 032 348 | A1 | 6/2016 |
| EP | 3 032 349 | A1 | 6/2016 |
| FR | 1 186 707 | A | 8/1959 |

OTHER PUBLICATIONS

Meis, Richard, *IWC-Uhren—Die Schaffhauser und ihre Geschichte*, Edition Catinthia, ISBN 3-85378-253-1, pp. 45-65 (1996).

Kuhn, Alex, *Die-Sprungziffern-Tsschenuhren*, Edition Simonin, ISBN 978-2-9700573-4-5, pp. 1-125 (2010).

Lesguillier, Christian, "Les montres digitales issues du brevet Pallweber et leurs concurrentes à la fin du 19$^{e}$ siècle," *Horlogerie Ancienne*, pp. 20-28 (2001).

Flores, Joseph, et al., "Montre dite 'Du Duc D'Aumale' à heures et minutes sautantes," *Horlogerie Ancienne*, pp. 52-63 (2002).

Excerpt from IWC's Catalogue, Annual Edition, pp. 300-301 (2014-2015).

Flores, Joseph, "Affichage Heures et minutes sautantes," *Horlogerie Ancienne*, pp. 20-28 (2001).

Excerpt from Homepage of A. Lange und Söhne, http://www.alange-soehne.com/de/zeitmesser/zeitwerk/#zeitwerk-minutenrepetition, Aug. 17, 2015.

* cited by examiner

TIMEPIECE WITH DIGITAL TIME DISPLAY

RELATED APPLICATION

The present application claims priority to Swiss Patent Application No. 00425/17, filed Mar. 30, 2017, the disclosure of which is hereby incorporated by reference herein in its entirety.

FIELD OF THE INVENTION

The present invention relates to the field of mechanical timepieces, in particular wristwatches, which are equipped with a digital time display by means of multiple numeric disks.

In particular, the present invention relates to a timepiece in the form of a wristwatch with a digital display, the wristwatch comprising a minute-units disk, a minute-tens disk, and an hour ring, and with a movement having a balance-spring system and a gear train by means of which a minute-units wheel of the minute-units disk is advanced rotatably with ten steps per revolution in cyclic steps, and with a switching device by by means of which the minute-tens disk is advanced rotatably with six steps per revolution, wherein the hour ring is advanced rotatably during one revolution of the minute-tens disk by the minute-tens disk via a Maltese intermediate wheel with twelve steps per revolution, as well as with a manually actuatable disk setting means, wherein the movement comprises at least a first barrel, a first transmission chain and a second transmission chain, wherein both transmission chains are connected to a release mechanism and the first transmission chain controls the second transmission chain by means of the release mechanism such that the second transmission chain transmits every minute, clocked via the balance-spring system of the movement, a force in the form of a rotational movement to the minute-units wheel.

BACKGROUND OF THE INVENTION AND PRIOR ART

Time pieces without hands, which indicated the time with moving or jumping numbers on rotating disks or rings, appeared as early as the 16th century. However, these were monumental clocks on towers or churches.

In the second half of the 19th century, jump hour pocket watches appeared, which digitally indicated both the hours and the minutes through mechanically jumping digits, wherein the seconds, however, were indicated in analog with a hand. In particular, the manufacturers IWC, Cortébert Watch, Gedeon Thommen, Aeby & Landry, Kaiser, and others produced such jump hour pocket watches. The expert can find an overview of this production at that time in the book "Die Sprungziffern-Taschenuhren" by Alex Kuhn, publishing company Simonin, 2010. The first technical descriptions of this type of watch can be found in particular in the so-called Pallweber patents, see, for example, the German Reich Patent 25 042 from 1883.

In the meantime, these pocket watches have been essentially completely ousted from the market by mechanical wristwatches with analog displays. In the sixties, cheaper electronic wristwatches with digital displays of any kind also appeared, which, at first glance, made a further development of mechanical watches with digital display seem little meaningful. In view of the current demands of the consumer in terms of accuracy of indication and adjustability, the field of mechanical watches having a digital time display can thus again be regarded as technical new ground.

A few innovations with respect to the pocket watch production of the 19th century shall be mentioned in the following:

The patent specification DE 10 2007 042 797 discloses a watch, in particular a wristwatch, having a main energy storage, by which, via a gear train, a tensioning element of a tensioning device forming a first device configured to be switched in a stepwise manner can be rotatably driven, controlled by a tensioning control, in cyclic steps about a tensioning axis and a storage hairspring connected with one end to the tensioning element is tensioned, wherein the other end of the storage harspring is connected to a wheel rotatably driving the movement, which is engaged with the train of the escapement, wherein a further device configured to be switched in a stepwise manner can be rotatably driven in cyclic steps by an element of the gear train from the main energy storage to the tensioning element. The movement of this watch is mainly used in so-called movements with constant torque and therefore has a tensioning device charging the storage hairspring at regular time intervals to avoid large torque fluctuations.

The patent specification DE 10 2009 019 335 discloses a watch, in particular a wristwatch, having a drive, through which a gear train of a digital display having a plurality of numeric disks can be rotatably driven in cyclic steps, wherein a drive wheel allows to rotatably advance a units wheel of a minute-units disk with ten steps per revolution, with a switching device which is driven by the units wheel and which allows to rotatably advance a minute-tens disk with six steps per revolution, and with an numeric hour disk which can be advanced rotatably by the minute-tens disk with twelve steps per revolution during a revolution of the minute-tens disk, wherein a pinion which engages in the gear train can be driven by a manually actuatable disk adjusting wheel, wherein the pinion is positively coupled via a locking mechanism with the drive wheel. The coupling realized by said locking mechanism between the pinion manually drivable by the disk adjusting wheel and the drive wheel of the train of this watch has a specific configuration and, in particular, is mounted axially sliding on the axis of the pinion arranged coaxially with the drive wheel, wherein the train is designed as a continuous gear train with successively driven numeric disks in order to save installation space and to reduce the number of components.

Swiss patent specification CH 511 471 also discloses such a watch, wherein a minute-units disk may be advanced rotatably with ten steps per revolution, with a switching device by which a minute-tens disk may be advanced rotatably with six steps per revolution and with an numeric hour disk which may be advanced rotatably by the minute-tens disk with twelve steps per revolution during a revolution of the minute-tens disk. The movement has a first transmission chain which transfers the force from a first barrel to a first escapement of a regulator of the watch, and a second transmission chain which transmits the force from a second barrel to the indicator disks, wherein the rotation of the wheels of the second transmission chain is controlled by a wheel of the first transmission chain. The necessary blocking of the second transmission chain between the stepwise advancing of the indicator disks as well as their release at the time of a step of advance is accomplished via second pallets of a second escapement in cooperation with superimposed, mutually rotatable plates, which requires a relatively complex structure of the movement.

An instantaneous display mechanism of a watch of this type is disclosed in the Swiss patent specification CH 581 857, wherein a drive wheel of a indicator disk meshes with an intermediate wheel, which is mounted on a rocker. A block of the rocker is engaged with a toothing of the disk, however, the block is released from the toothing both during a manual correction operation as well as by the automatic dislocation of the rocker during the normal course of the watch.

The European Patent Application EP 3 032 348 also discloses an instantaneous display mechanism which comprises a drive wheel, a time display and a jumping member that is mounted on said time display and coaxial with the drive wheel, as well as a cam configured to release four-arm pallets once per unit of time. This arrangement is especially designed for displays that realize a jumping switching every second, in particular using a single source of energy in the watch movement.

Problem of the Invention

Despite the previously known embodiments, it is further desirable to provide a watch of the above mentioned type which shows an as small a change as possible of the amplitude of the balance-spring system, respectively of the frequency of the regulator of the movement, during the stepwise rotation of the indicator disks that are relatively heavy as compared to hands,

- has the most accurate possible releasing of the stepwise rotation of the indicator disks, comprises a simple and robust system for said stepwise rotation of the indicator disks as well as for securing them between the steps of advancing, disposes of a manually actuatable disk setting means, which allows an adjustment of the time in both directions and at the same time realizes a safe setting process without possibility of damage to the watch mechanism,
- enables an aesthetically pleasing time display with reasonable space requirements of the indicator disks and thickness of the movement, as well as in all
- allows easy installation and represents a solution suitable for series production.

The aim of the present invention is therefore to avoid the disadvantages of the previous embodiments, the realization of the above-mentioned advantages, and to provide a watch which disposes of a digital display having several numeric disks, wherein the numeric disks should be released instantaneously and be advanceable with the least possible expenditure of energy. In particular, the indicator disks should stand for one minute, while at the end of each minute, as soon as the second hand has reached sixty seconds, the minute-units disk should be immediately released and further rotated by one position. At the end of ten minutes, the minute-tens disk should additionally be further rotated and, at the end of one hour, the hour disk further rotated by one more position. A further object of the present invention is the provision of a manually actuatable disk setting means for safe setting of the time in both directions. A further object of the present invention is an attractive digital time display in the context of mechanical wristwatches. This is to be achieved by using a movement that is designed constructionally as simple and robust as possible and that ensures safe operation.

SUMMARY OF THE INVENTION

According to a first aspect of the invention, a timepiece according to the invention comprises, in particular, a release mechanism with a control disk, two release levers each having a first lever arm and a second lever arm, and a release wheel, wherein the first lever arms of the two release levers are positioned in shifted manner and bear with pressure on the circumference of the control disk such that, after the end of every minute, the first lever arm of one of the release levers falls from the control disk edge into a recess of the control disk and the second lever arm of this release lever releases the release wheel of the release mechanism, such that the second transmission chain rotates freely until a tooth of the release wheel strikes against the second lever arm of the other release lever, thus allowing the minute-units wheel and the minute-units disk to rotate by one step, and the first transmission chain comprises a centre wheel driven by the first barrel, a third wheel driven by the centre wheel, and an intermediate pinion meshing with the third wheel, wherein said control disk is fastened to the axis of the intermediate pinion.

These features achieve a number of advantages, in particular, the amplitude fluctuations in the balance-spring system are kept low and it is possible to implement sixty releases per hour with a comparatively simple assembly, in particular thanks to a control disk designed as a cam disk divided into two sections and two associated levers, which has the advantage that the steps or sections can be made larger, which in turn causes a safer functional sequence.

According to a second aspect of the invention, a timepiece according to the invention comprises a manually actuatable disk setting means which has a plurality of setting wheels respectively serially meshing with each another, which are movable by a winding stem in its pulled-out position by means of a coupling pinion, wherein the last setting wheel is fixedly attached to the minute-units disk and the assembly consisting of the last setting wheel and the minute-units disk is arranged loosely and freely rotatable on an intermediate wheel pinion, which is a part of the second transmission chain, and wherein a star is coaxially fastened to the intermediate wheel pinion and a conjugately shaped detent spring is mounted on the minute-units disk to allow the alignment of the minute-units disk in a dial window of the timepiece as well as, in the presence of a higher force than the detent spring force, to allow a stepwise coupling and decoupling between the intermediate wheel pinion and the minute-units disk.

These features allow to realize a disk setting means with a safe setting of the time in both directions, wherein the disk setting means has a simple and effective coupling between the intermediate wheel pinion and the minute-units disk.

According to a third aspect of the invention, in a timepiece according to the invention, the axes of the minute-units and minute-tens disks are arranged parallel to each other and inside the hour ring, wherein the minute-units disk is configured with at least two stages and the edge of its upper stage bearing digits is opposite the edge of the minute-tens disk, such that the surfaces of the two disks lie in the same plane. Preferably, the minute-units disk, the minute-tens disk and the hour ring of the digital display are also connected to one another via a switching device in the form of a Maltese cross drive.

These features realize an aesthetically pleasing, digital time display for mechanical timepieces, wherein the display leads to a reasonable thickness of the movement with a comparatively small space requirement of the indicator disks. In addition, the arrangement of the axes of the minute-units and minute-tens disk parallel to each other and inside the hour ring allows a certain freedom in the arrangement of the time display on the dial of the timepiece.

Further features and advantages will become apparent from the dependent claims as well as from the description setting out in detail the invention in the following by means of the accompanying drawings.

BRIEF DESCRIPTION OF THE DRAWINGS

The accompanying drawings illustrate by way of example two embodiments of a timepiece with a digital display according to the invention. It is shown in FIG. 1*a* perspective views of the numeric disks from the dial side and bridge side, FIG. 1*b* a perspective view of the indicator disks, with recesses for ease of understanding, in the position before a minute and hour jump, FIG. 1*c* a perspective view of the indicator disks, also with recesses for ease of understanding, during the switching, FIG. 2 a plan view from the bridge side of a first embodiment of the gear train, FIG. 3*a* an oblique perspective view of the release mechanism of the gear train of FIG. 2, FIG. 3*b* a top view of the release mechanism of FIG. 3*a*, FIG. 3*c* a side view of the release mechanism of FIG. 3*a*, FIG. 4 a detailed perspective view of the release lever of FIG. 3*a*, FIG. 5 a plan view from the bridge side of a second embodiment of the gear train, FIG. 6 a perspective view of the driving gear train of FIG. 5, FIG. 7 a detail view of the release lever of FIG. 5, FIG. 8*a* a detail view of the release mechanism of FIG. 5 in plan view, FIG. 8*b* a detail view of the release mechanism of FIG. 5 in sectional view, FIG. 9 a plan view of the winding mechanism in the position for adjusting the numeric disks, wherein some parts are shown transparent for ease of understanding, FIG. 10*a* a sectional view of the disk setting means of the minute-units disk, in particular in the upper part of the view, while in the lower part, the second transmission chain for driving the digital display is partially visible, FIG. 10*b* a plan view of the coupling elements of the disk setting means of the minute-units disk, FIG. 11 a plan view of the winding mechanism in two positions, FIG. 12*a* a detail view of the blocking system in a position, FIG. 12*b* a detail view of the blocking system in a further position, FIG. 12*c* a detail view of a blocking system that has an alternative embodiment of the blocking lever, FIG. 12*d* a detail view of a blocking system that has a further alternative embodiment of the blocking lever, FIG. 13 a plan view from the movement side of the winding wheels, FIG. 14*a* a detail view of the winding mechanism in sectional view, FIG. 14*b* a detail view of the winding mechanism in an oblique view.

DETAILED DESCRIPTION OF THE INVENTION

Two embodiments of the invention are now described in detail below with reference to the drawings.

Figure 1A:
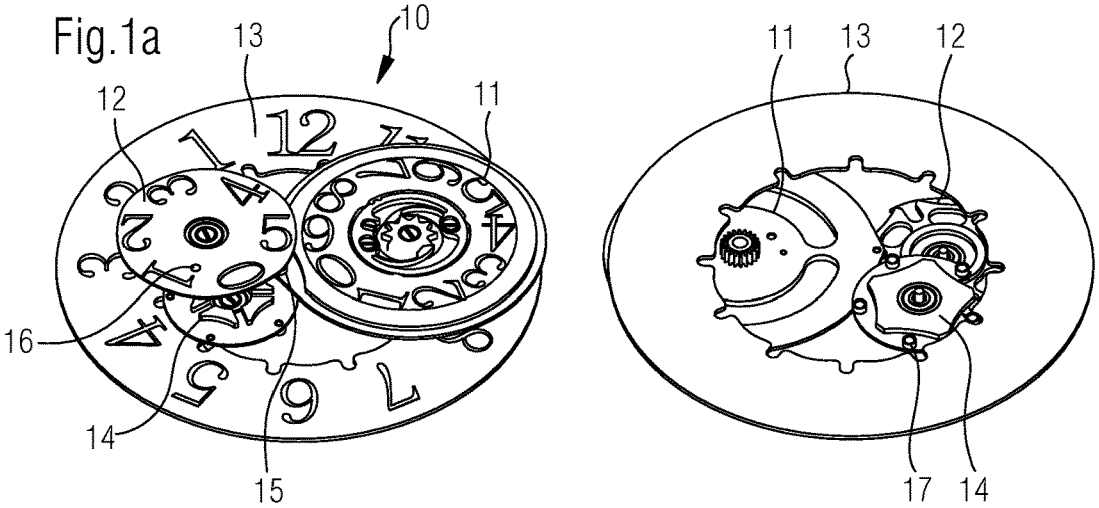
Figure 1B:
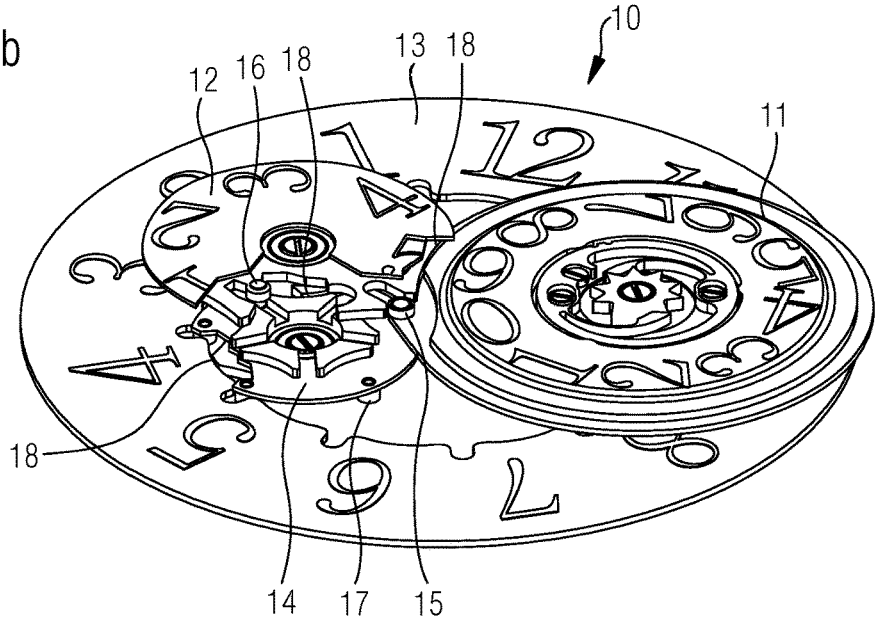
Figure 1C:
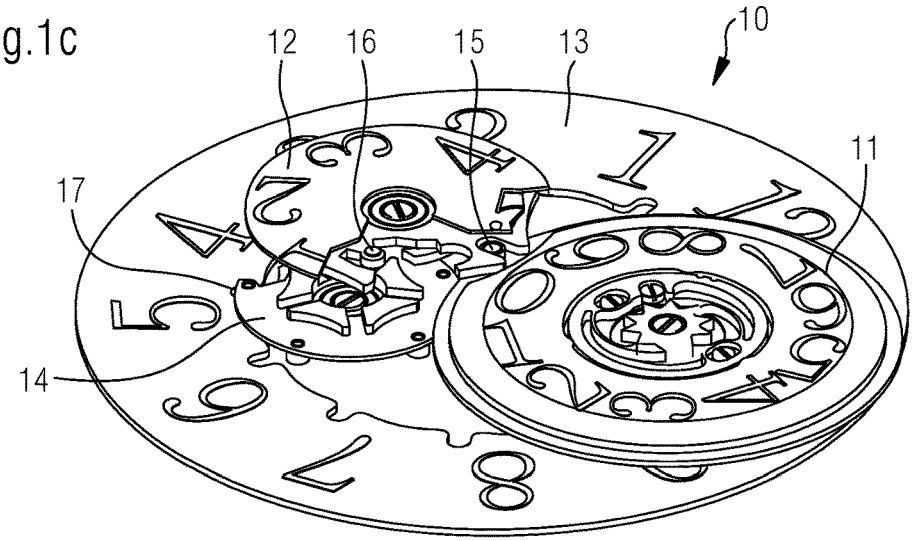

A digital display 10 with a drive and release system for the disk rotation according to the present invention is intended for integration into a wristwatch. As shown in FIGS. 1*a*, 1*b* and 1*c*, the digital display 10 includes a minute-units disk 11, a minute-tens disk 12, and an hour disk configured as an hour ring 13. The axes of the minute-units disk 11 and the minute-tens disk 12 are arranged parallel to each other and inside the hour ring 13, wherein these axes are perpendicular to the plane of the digital display. The minute-units disk 11 is configured with at least two stages, wherein the edge of its upper stage bearing digits is opposite of the edge of the minute-tens disk 12 and the surfaces of the two disks 11, 12 lie in the same plane.

The three display disks 11, 12, 13 of the digital display 10 are connected to each other via a switching device, which is configured in this embodiment as a Maltese cross drive. The latter is structured as follows: The lowest stage of the minute-units disk 11 carries a roller 15 which engages in the Maltese train on the bottom side of the minute-tens disk 12 and which causes the latter to turn during the switching of the minute-units disk 11 from the numeral "9" to the numeral "0", wherein a rotation of the minute-units disk 11 by 36° causes a rotation of the minute-tens disk 12 by 60°. If the indicator disks stand as shown in FIG. 1*a*, that is just before the switching of the minute-tens disk 12 from the numeral "5" to the numeral "0", then a press fitted pin 16 of the minute-tens disk 12 engages in the Maltese contour of the Maltese intermediate wheel 14 and rotates the latter during the switching of the minute-tens disk 12 from the numeral "5" to the numeral "0" by the minute-units disk 11, whereby a rotation of the Maltese intermediate wheel 14 by 72° is effected. By the rotation of the Maltese intermediate wheel 14, one of the rollers 17 positioned at regular angular intervals on the bottom side of the Maltese intermediate wheel slides into the Maltese groove of the hour ring 13 and also switches the latter by one position, which corresponds to a rotation by 30° of the hour ring 13. The engagements of this Maltese cross drive are shown in FIG. 1*c* in a position during the switching operation. After completion of each switching operation, the respective locking radii 18 of the Maltese contours of the indicator disks 11, 12, 13 face each other again and hold the indicator disks of the digital display 10 in their position. It should generally be noted here that the components 15, 16, 17 can be designed both as rollers and as a pin, wherein the choice depends on the available thickness of the associated disk stage. If the thickness is sufficient, design as a roller is preferred because of the better friction reduction.

Figure 2:
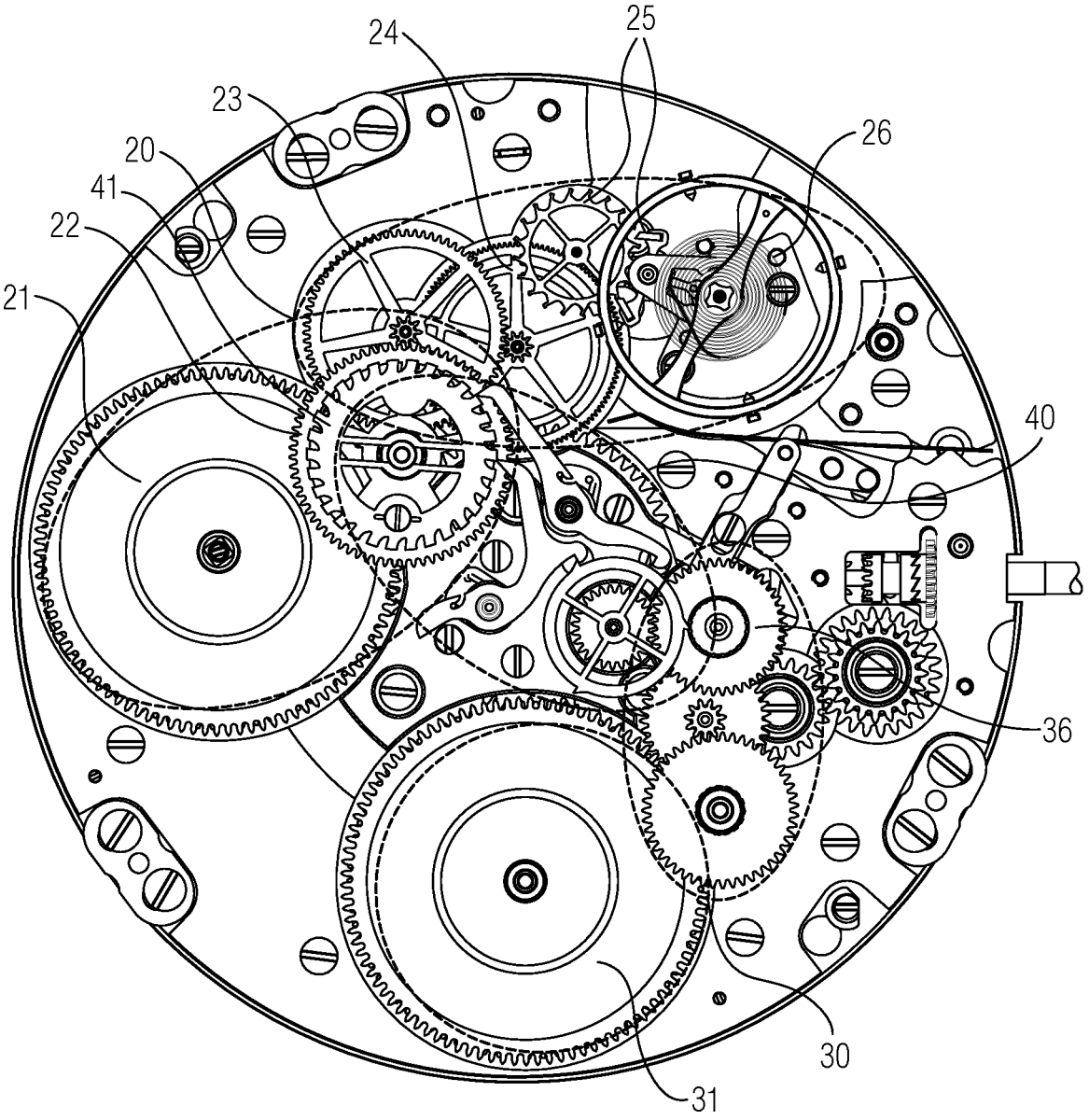

A first embodiment of a movement of a timepiece housing this digital display 10 is now described below with reference to FIGS. 2 to 4. This movement has, on the one hand, a driving gear train which comprises a first, conventional transmission chain 20 and a first barrel 21, as is also used in an ordinary movement according to the prior art. In this driving gear train, the force is transmitted from the first barrel 21 via gearwheels, each with drives fastened thereto, in particular via a minute wheel 22, a third wheel 23 and a fourth wheel 24, to an escapement 25 and a balance-spring system 26 of the movement. In the prior art, in addition to the force transmission, this transmission chain would have the task of controlling the hands or other displays. In contrast, a movement according to the present invention has, on the other hand, a switching gear train, which comprises a second transmission chain 30 and a second barrel 31 with associated transmission gearing. These two transmission chains 20, 30 are connected to each other by a release mechanism 40, wherein the first transmission chain 20 of the driving gear train every minute, clocked via the balance-spring system 26, controls the second transmission chain 30 of the switching gear train by means of the release mechanism 40. This second transmission chain 30 transmits the force from the second barrel 31 in the form of a rotational movement to the indicator disks 11, 12, 13.

Figure 3A:
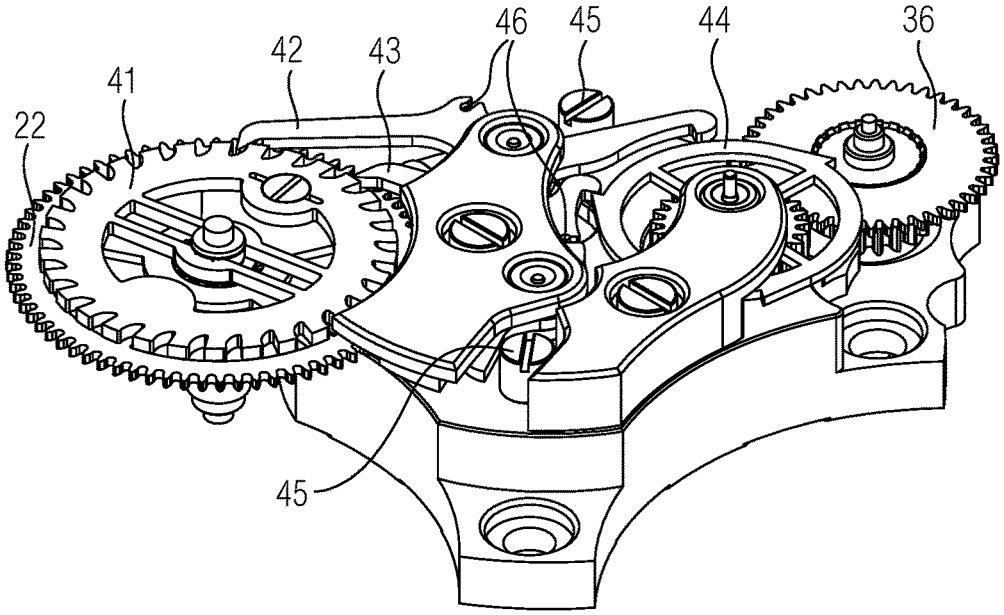
Figure 3B:
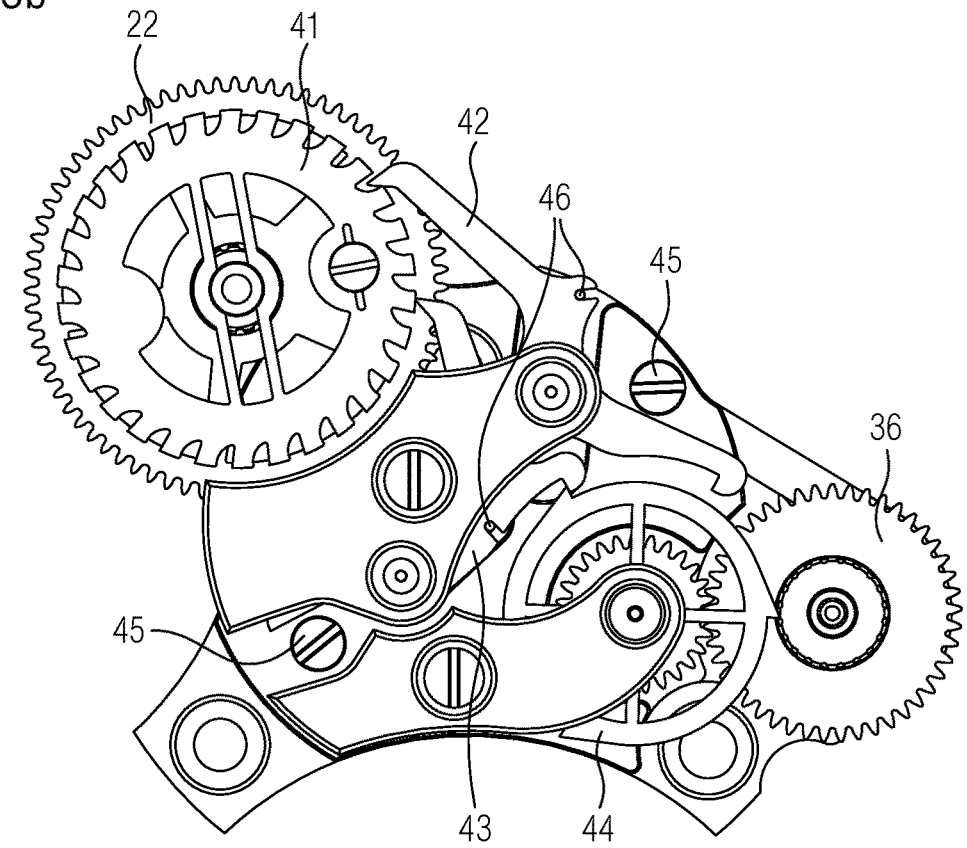
Figure 3C:
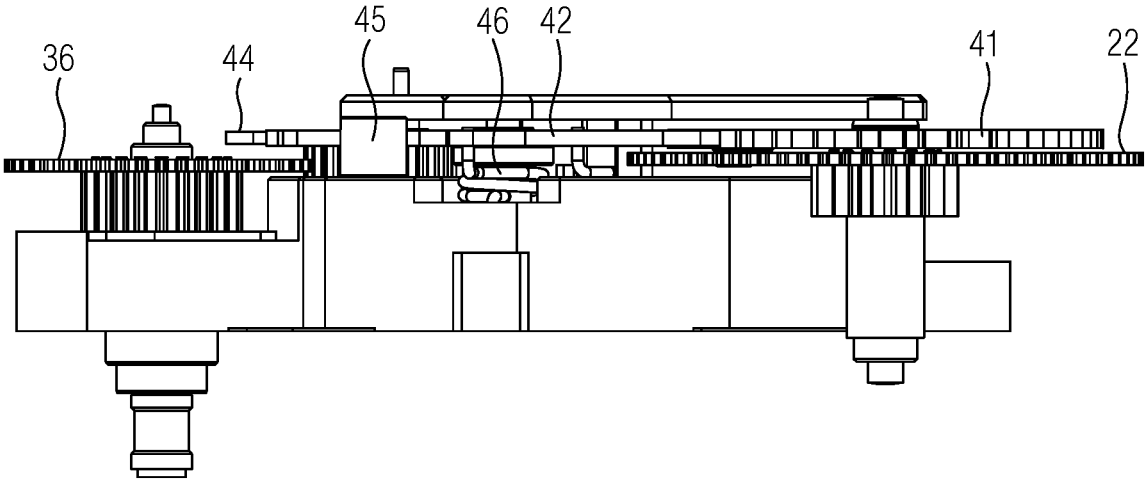
Figure 4:
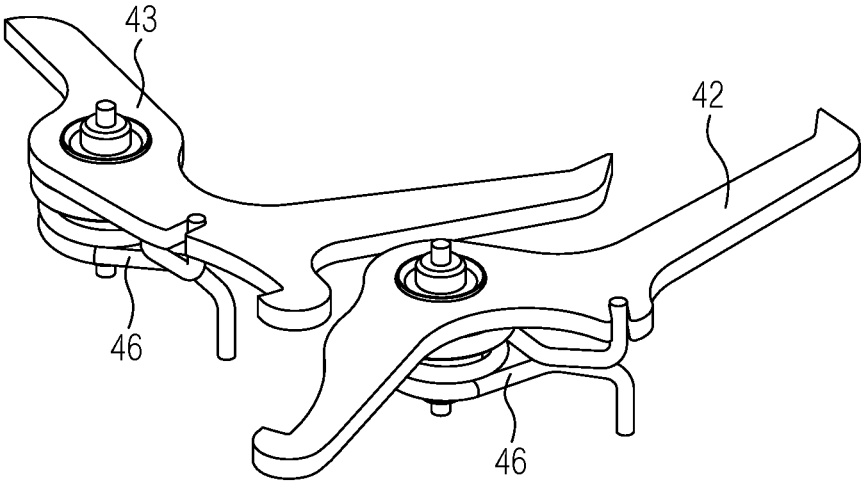

In order to ensure a high releasing precision during the switching operations of the digital display 10 and simultaneously to minimize amplitude fluctuations in the balance-spring system 26 of the movement, in this embodiment, the release mechanism 40, as shown in FIGS. 3*a* to 3*c*, comprises a control disk in shape of a step disk 41 having thirty sections with a total angular width of 12°, each section having a step and a recess or gap, wherein the step disk 41 is fastened to the axis of the minute wheel 22. The release mechanism 40 also has two pivotally arranged release levers 42, 43, shown in FIG. 4 in a detailed view, each with two lever arms, whose first lever arms are each directed by a release spring 46 against the circumference of the step disk 41 and rest on the latter with light pressure. The release levers 42, 43 are positioned in offset manner relative to each other around the circumference of the step disk 41 such that the ends of said first lever arms rest on the step disk 41 offset by a half pitch of the step disk 41 or engage in the latter, as can be seen in FIG. 3*b*. It is possible to implement sixty releases per hour with a 30-stage step disk 41 by this arrangement, which has the advantage that the steps can be made larger. The release mechanism 40 further has a release wheel 44 which is released or blocked by the second lever arms of the release levers 42, 43, depending on their location around the circumference of the step disk 41.

The total angular width of 12° of the sections of the step disk 41 can preferably be divided asymmetrically in order to further increase the functional reliability of the release mechanism 40. For example, the angular width of the step shown in FIGS. 3*a* and 3*b* is preferably in the range 6.1° to 10° and that of the gap in the range 2° to 5.9°, thereby ensuring that shortly before the start of the releasing operation, that is just before the fall of the first lever arm of one of the release levers 42, 43 into a gap of the step disk 41, the first lever arm of the other release lever 42, 43 has already taken its final position on the step. Of course, the angular width given above can be chosen differently depending on the configuration of the step disk 41. Furthermore, the release levers 42, 43 can advantageously be designed such that their first and second lever arms, which preferably each correspond to a short lever arm and a long lever arm, each have the same length on both release levers 42, 43. Preferably, for each release lever 42, 43, an eccentric is also provided on the short lever arm, which eccentric at the end of the releasing operation, that is during the fall of the first lever arm of one of the release lever 42, 43 in a gap of the step disk 41, prevents the striking of this first lever arm on the bottom of the step disk 41. This allows to reduce the wear on the probe tips of the release levers 42, 43.

During the normal operation of the movement, the step disk 41 continuously rotates with the minute wheel 22, wherein the first lever arms of the two release levers 42, 43 slide over the surface of the outer circumference of the step disk 41. At the end of each minute, the first lever arm of one of the release levers 42, 43 falls from the step disk edge into a gap of the step disk 41 and releases the release wheel 44 by means of its second lever arm. As a result, the second transmission chain 30 of the switching gear train can rotate freely until the tooth of the release wheel 44 strikes against the second lever arm of the other release lever 42, 43. Thus, the minute-units disk 11, which is preferably directly mounted on or in kinematic connection with a minute-units wheel 36 of the second transmission chain 30 of the switching gear train, rotates one step further, which corresponds to a rotation of 36° and each time makes visible the next digit on the minute-units disk 11 in a window (not shown in the figures) in the dial of the watch.

Figure 5:
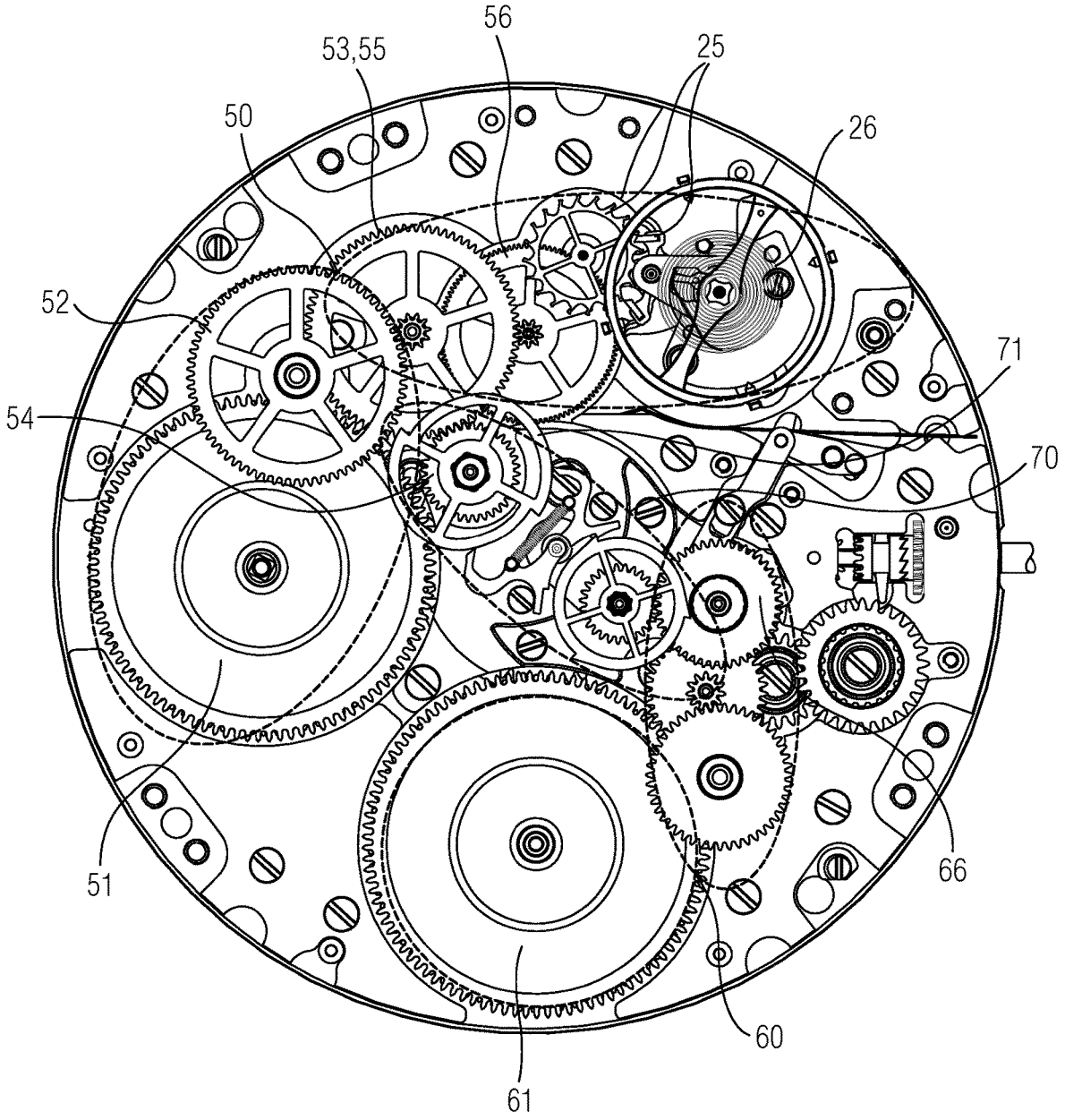
Figure 6:
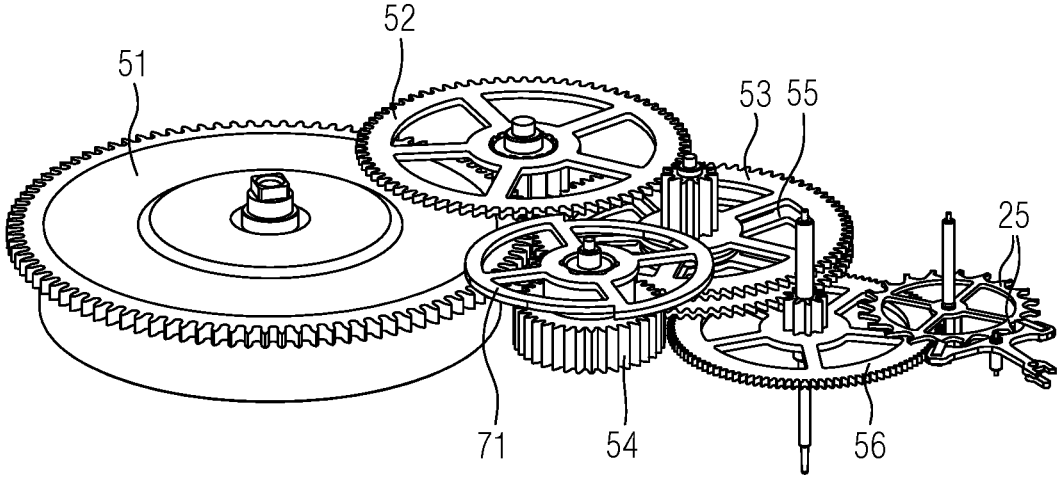

A second embodiment of a movement of a timepiece housing the digital display 10, which has a further improved releasing accuracy, is now described below with reference to FIGS. to 8*b*. Similar to the movement of the previously described embodiment, the movement according to the second embodiment has, as shown in FIGS. 5 and 6, on the one hand, a driving gear train that comprises a first transmission chain 50 and a first barrel 51. In this driving gear train, the force from the first barrel 51 is transferred via gear wheels with drives each fastened thereto, in particular via a minute wheel 52 also referred to as centre wheel in the following, a third wheel 53, an intermediate pinion 54, a third additional wheel 55, and a fourth wheel 56, to an escapement 25 and a balance-spring system 26 of the movement. Compared to a conventional train of a driving gear train, the third wheel 53 with the third wheel pinion fastened thereto was supplemented by a third additional wheel 55 which is loosely mounted on the third wheel pinion and which therefore is freely rotatable. The wound barrel 51 transmits the force of its balance spring respectively tension spring as torque via the centre wheel 52 to the third wheel pinion of the third wheel 53, whereby the third wheel 53 riveted on the axis of the third wheel pinion is rotated. The latter in turn transmits the torque to the intermediate pinion 54, which supports a control disk in the form of a cam disk 71 and transmits the torque to the third additional wheel 55 loosely mounted on the third wheel pinion, the third additional wheel 55 being in engagement with the fourth wheel pinion of the fourth wheel 56. From here, the torque transmission continues in a conventional manner to the escapement 25 and the balance-spring system 26 of the movement.

In contrast to the release mechanism 40 according to the first embodiment of a movement according to the invention, in which the tapping of the moment in time of release is done using the minute wheel 22, respectively the step disk 41 fastened thereto, the tapping of the moment in time of release is carried out in the second embodiment of a movement according to the invention using the third wheel 53, due to the fact that the cam disk 71 is fastened to the intermediate pinion 54 meshing with the third wheel 53. The available torque is therefore slightly lower compared to the first embodiment of a movement according to the invention, but is sufficient and higher than the torque on the fourth wheel 56. On the other hand, by this way the rotational speed of the cam disk 71 of the second embodiment of a movement according to the invention, which is one revolution per hour at the step disk 41 of the first embodiment, can advantageously be significantly increased to one revolution per four minutes, since the modification of the transmission chain 50 by adding the intermediate pinion 54 and the loosely mounted third additional wheel 55 allows a modified and, depending on needs, within certain limits selectable number of teeth or gear transmission ratio at these wheels. The number of sections, each with a tooth and a recess, on the cam disk 71 is also accordingly selectable, wherein the cam disk 71 of the second embodiment of a movement according to the invention, as shown in FIGS. 5 and 6, comprises two such sections. The cam disk 71 fastened to the intermediate pinion 54 can therefore rest directly and without play in the power flow of the first transmission chain 50 despite the advantageously increased rotational speed.

Like the first embodiment of a movement according to the invention, a movement according to the second embodiment of the present invention, on the other hand, has a switching gear train, which, as shown in FIG. 5, comprises a second transmission chain 60 and a second barrel 61 with associated transmission gear. The two transmission chains 50, 60 are connected to each other by a release mechanism 70, wherein the first transmission chain 50 of the driving gear train controls the second transmission chain 60 of the switching gear train by means of the release mechanism 70. This second transmission chain 60 transmits, analogously to the relevant description of the first embodiment, every minute, clocked via the balance-spring system 26, the force from the second barrel 61 in the form of a rotational movement to the minute-units wheel 66 and thus to the indicator disks 11, 12, 13, which allows their stepwise advancement.

Figure 7:
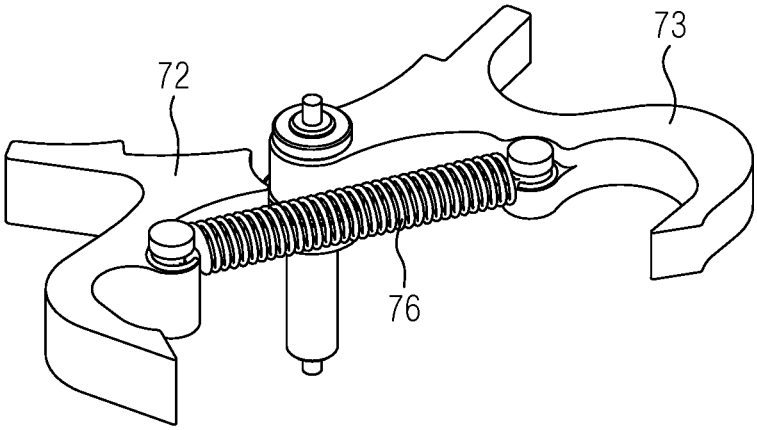
Figure 8A:
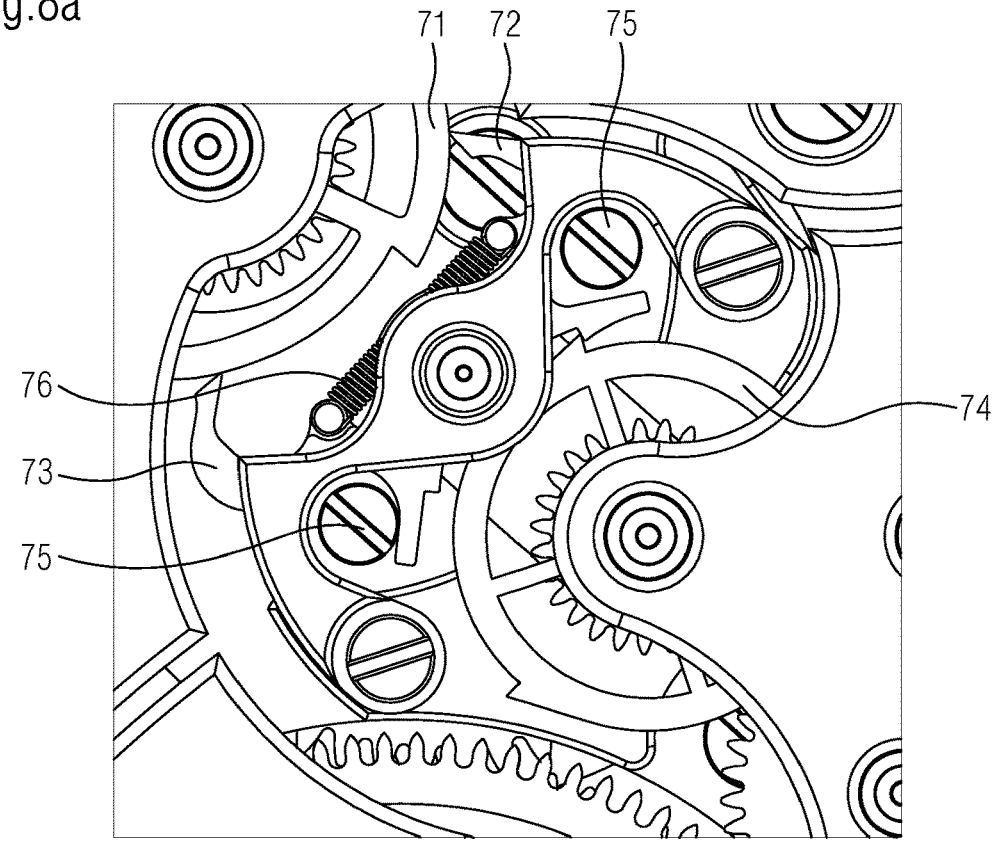

The release levers of the release mechanism 70 are also designed analogously to those of the first embodiment and are designed as pivotally arranged release levers 72, 73, each with a first and a second lever arm which preferably each correspond to a short and a long lever arm, with the difference that the axes of both levers are arranged coaxially. One of the release levers 72 is fixedly connected to an associated shaft serving as a pivot axis and the other release lever 73 is loosely and freely rotatably mounted on the pivot axis and axially secured with a bushing, as shown schematically in FIG. 7. By this arrangement, only one release spring 76 designed as a tension spring is required in the release mechanism 70, instead of the two release springs 46 of the release mechanism 40 of the first embodiment of the movement, the release spring 76 pressing the release levers 72, 73 against the cam disk 71. In the assembled state of all components of the release mechanism 70 in the movement, this release spring 76 is always slightly biased, which ensures that the two release levers 72, 73 bear against either the cam disk 71 or an eccentric 75 provided for each release lever 72, 73, such as can be seen from FIG. 8*a*. As in the first embodiment, the eccentrics 75 in this embodiment also have the task of preserving the probe tips at the ends of the first lever arms of the two release levers 72, 73 and of not letting them strike on the bottom of one of the recesses of the cam disk 71. Analogously to the division of the sections of the step disk 41 of the first embodiment, the pitch of the sections of the cam disk 71 may also be constructed asymmetrically to ensure that shortly before the start of the releasing operation, that is shortly before the fall of the first lever arm of one of the release lever 72, 73 from a tooth of the cam disk 71 into its subsequent recess, the first lever arm of the other release lever 72, 73 has already reached its final position on the circumference of the cam disk 71, in order to ensure the functional reliability of the release mechanism 70 in the same way. The release mechanism 70 further has a release wheel 74 which is released or blocked by the second lever arms of the release levers 72, 73, depending on their location around the circumference of the cam disk 71, and thereby, analogously to the descriptions above in connection with the second transmission chain 30 of the first embodiment, causes by means of the second transmission chain 60 of the switching gear train the gradual advancement of the numeric disks 11, 12, 13 of the digital display 10.

Figure 9:
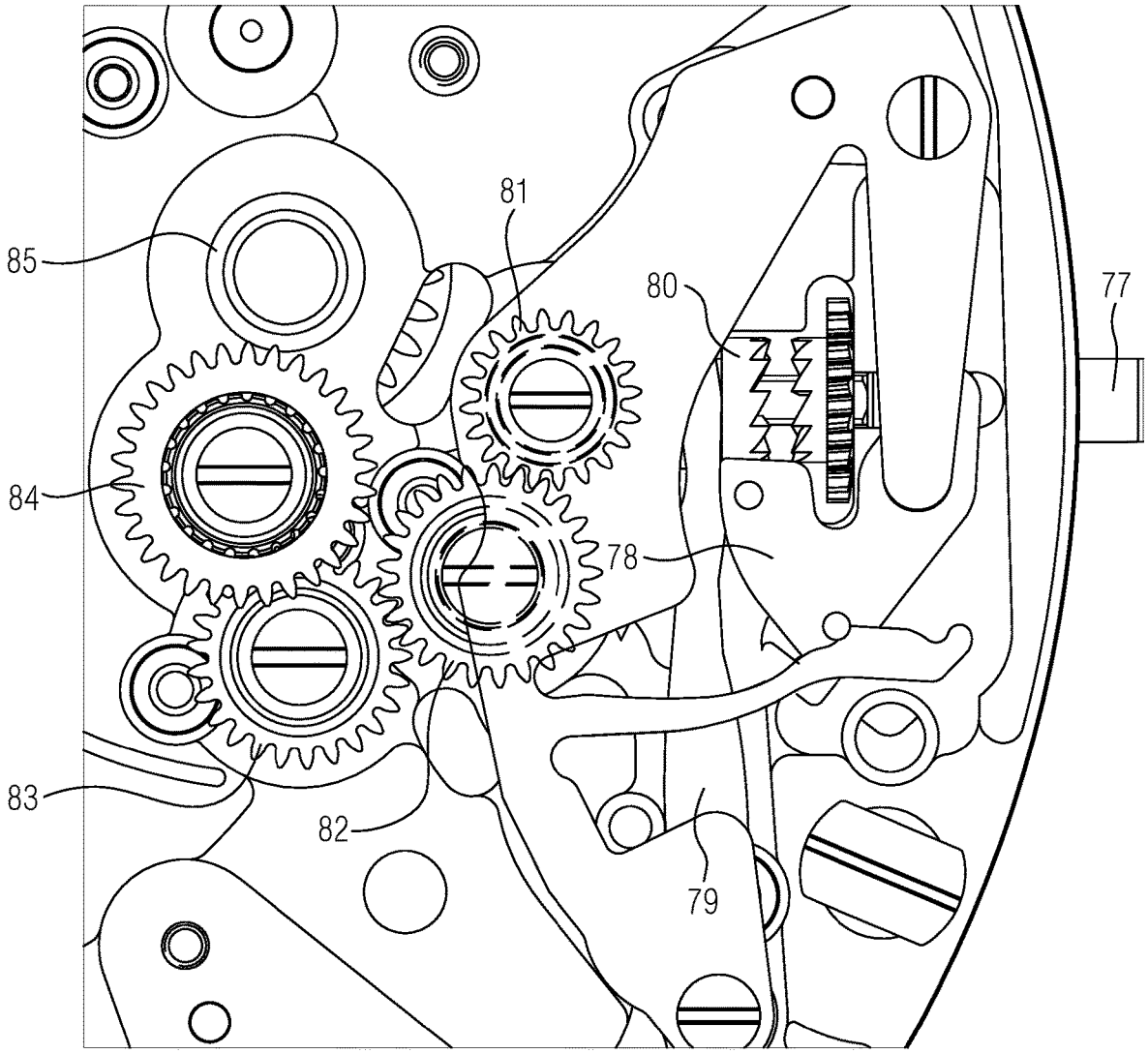

In the following, the manually actuatable disk setting means, which allows the manual adjustment of the position of the numeric disks 11, 12, 13 of the digital display 10, is now described with reference to FIGS. 9, 10*a* and 10*b*. As can be seen in FIG. 9, the disk setting means has a plurality of setting wheels 81, 82, 83, 84, 85 which are meshing in series with each other and which may be set in motion by a winding stem 77 in its pulled-out position by means of a coupling pinion lever 79. The disk setting means can be actuated by pulling the winding stem 77, thereby rotating an angle lever 78. The latter causes, via its outer shape, the coupling pinion lever 79 to pivot. The one end of the coupling pinion lever 79 engages in the groove of a coupling pinion 80. In the pulled-out position of the winding shaft 77, the aforementioned parts assume the position shown in FIG. 9, so that the setting wheels 81, 82, 83, 84, 85 can be put into rotation by manually rotating the winding shaft 77. The last setting wheel 85 is fixedly mounted on the minute-units disk 11 and this assembly is arranged loosely and freely rotatable on the intermediate wheel pinion 86, which is part of the second transmission chain 30, 60 of the switching gear train.

Figure 8B:
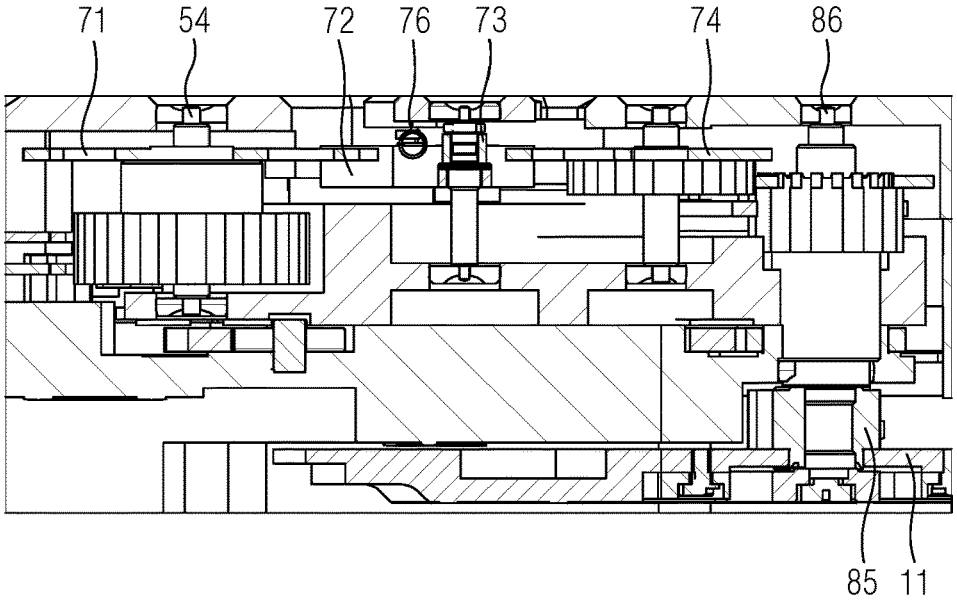
Figure 10A:
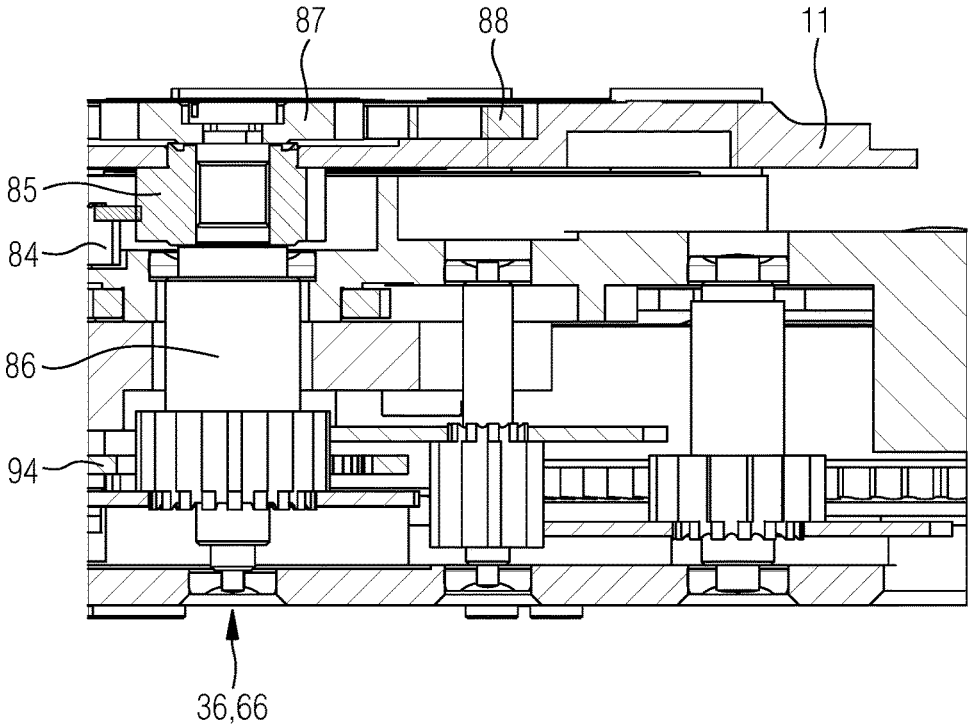
Figure 10B:
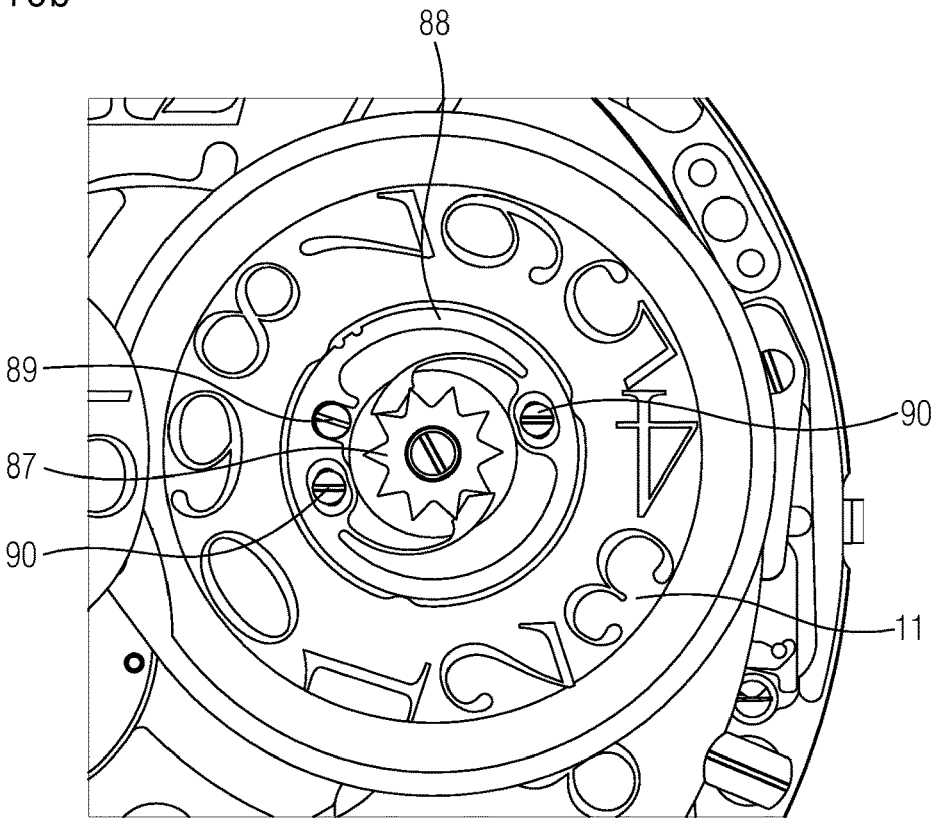

The bearing stud of the intermediate wheel pinion 86 is, as shown in FIG. 10*a* or 8*b*, configured at the end of a positive connection and includes a threaded hole, wherein these two elements are used to mount and index a star gear or star 87 to the intermediate wheel pinion 86, the star 87 limiting the height clearance of the minute-units disk 11. The star 87 has ten teeth. As shown in FIGS. 10*a* and 10*b*, a detent spring 88 is also fastened to the minute-units disk 11, for example screwed with screws 90, wherein the detent spring is formed conjugate to the shape of the star 87 and is comprised of several functional parts combined in one component. This detent spring 88 can be rotated by a certain angle by means of an eccentric 89, which is pressed into the minute-units disk 11. By the interaction between the star 87 and the detent spring 88, on the one hand, the minute-units disk 11 is aligned exactly in the dial window. On the other hand, the star 87 and the detent spring 88 form a frictional coupling, which, in the presence of a higher force than the detent spring force, allows a relative displacement in ten steps between the intermediate wheel pinion 86 and the last setting wheel 85 fixedly mounted to the minute-units disk 11. At this point, for the sake of completeness, it should be noted that both the intermediate wheel pinion 86 and the setting wheel 85 can be functionally equated with the part designated as a minute-units wheel 33, 66 in the above description of the two embodiments of the movement according to FIG. 2, respectively according to FIG. 5.

As soon as the winding stem 77 is rotated in its pulled-out position, the minute-units wheel 11 is put into rotary motion by the above-mentioned wheel chain shown in FIG. 9 from the winding stem 77 via the coupling pinion 80 and the setting wheels 81, 82, 83, 84, 85. The detent spring 88 at the same time jumps from one tooth gap of the star 87 into the next, such that the desired time can be set. Once the rotation of the winding stem 77 is stopped at any time, the detent spring 88 slides in the nearest gap of the star 87. The disk setting means, including the clutch consisting of the star 87 and the detent spring 88, is designed to set the time in both directions.

Figure 11:
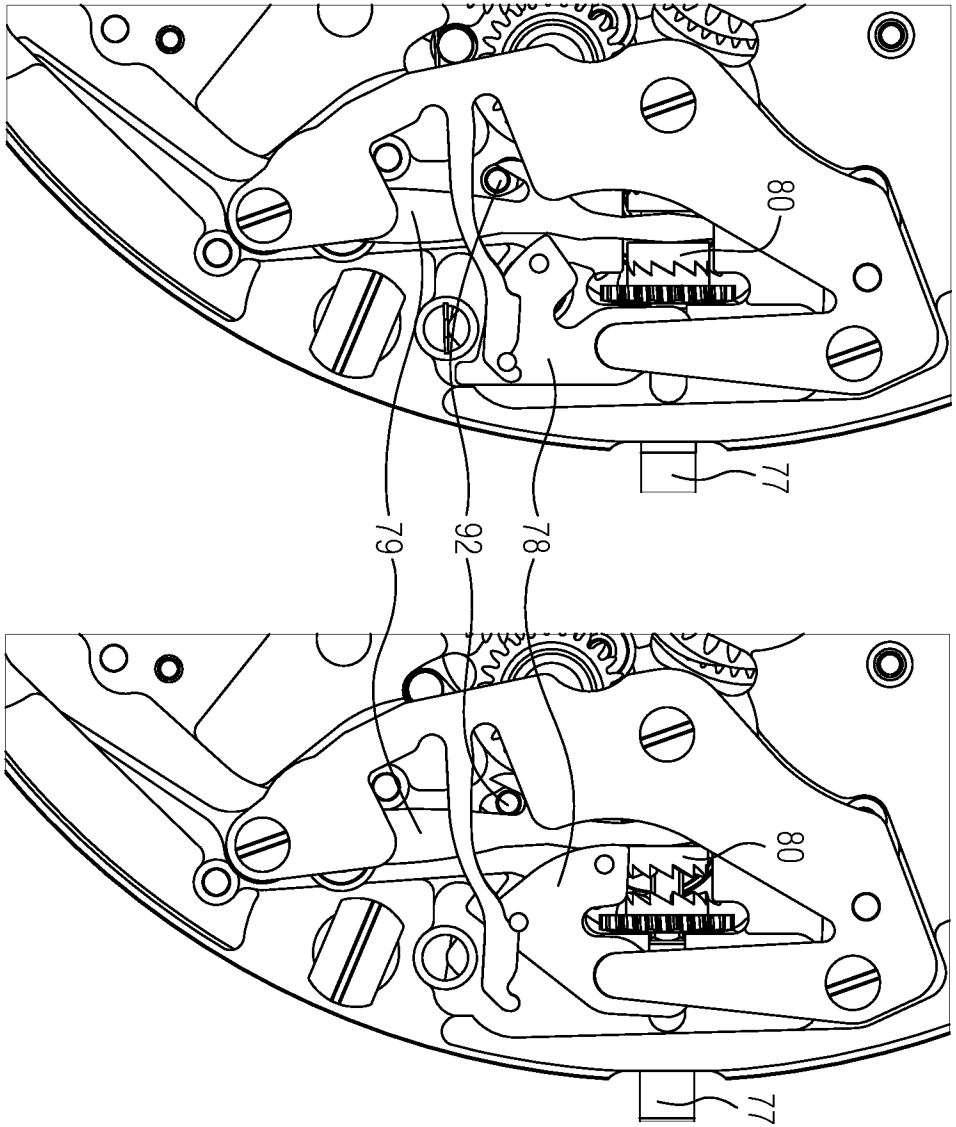
Figure 12A:
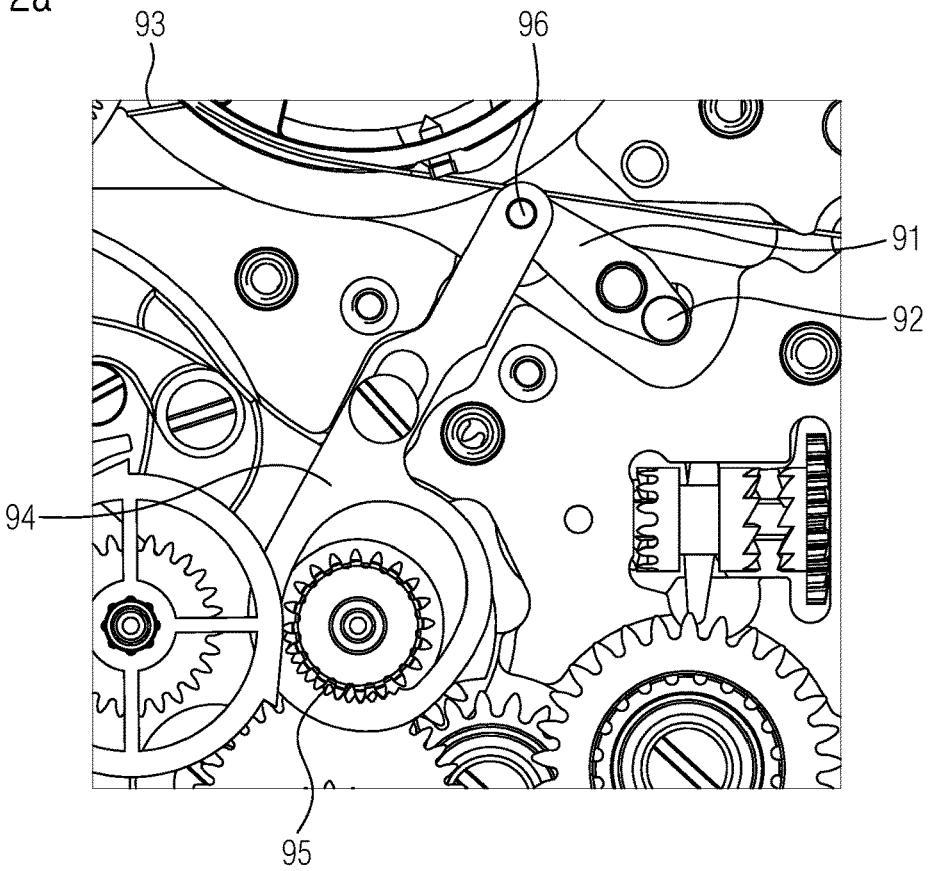
Figure 12B:
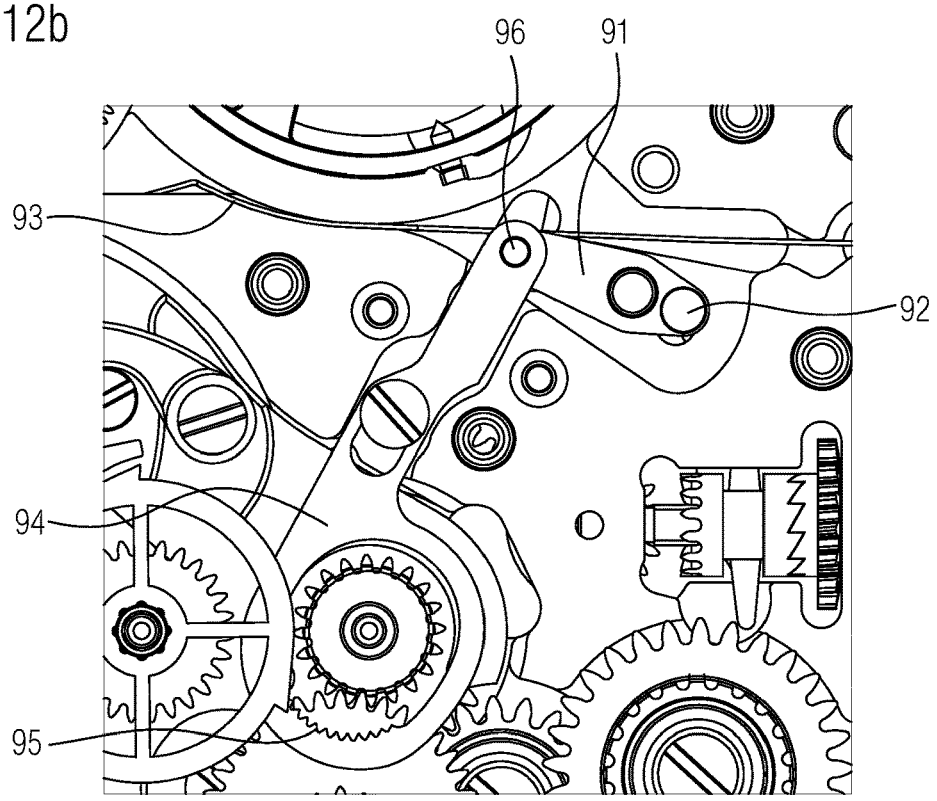
Figure 12C:
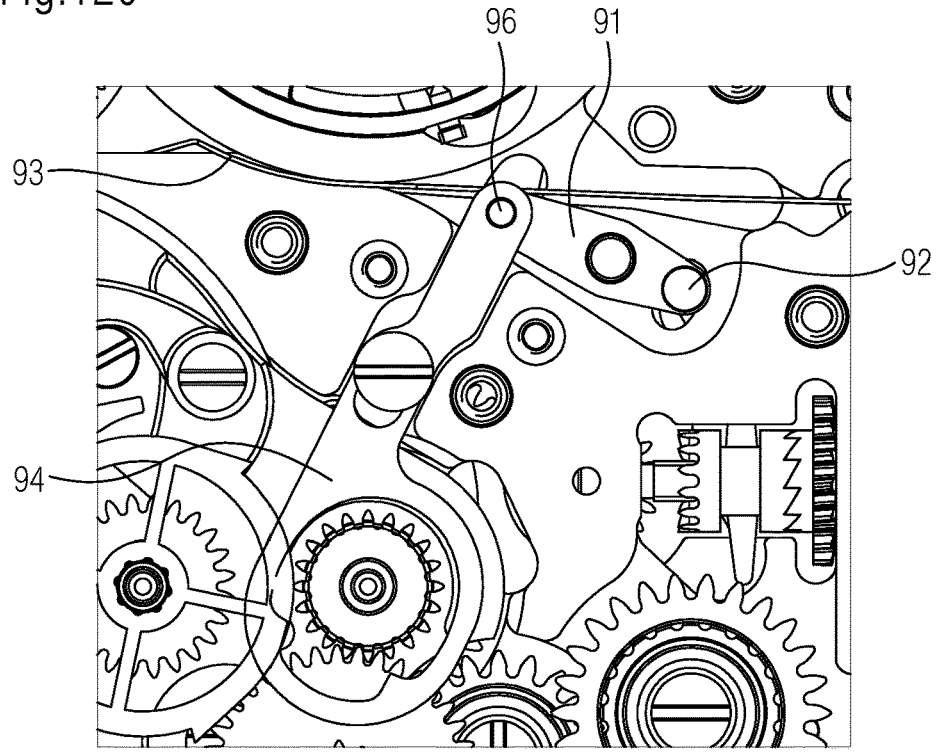
Figure 12D:
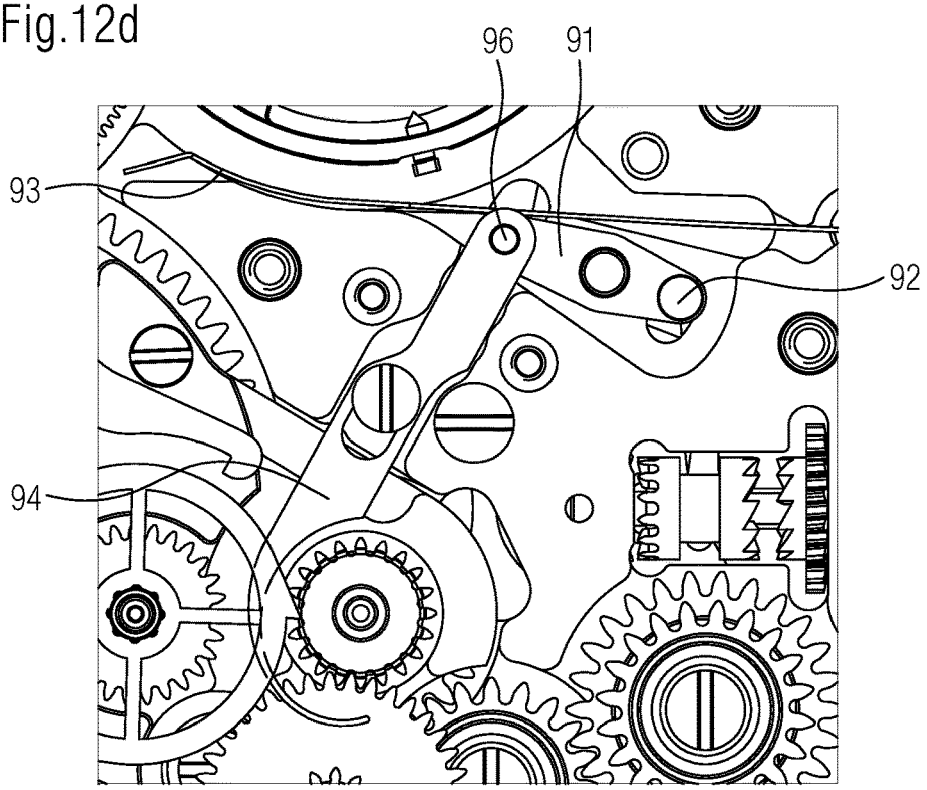

Preferably, the disk setting means further comprises a blocking device, a corresponding embodiment of the device now being described with reference to FIGS. 11, 12*a* and 12*b*. During the clockwise adjustment of the time, a torque acts in the direction of rotation of the second transmission chain 30, 60 of the switching gear train, wherein this rotational movement, as is apparent from the above description of the movement, is blocked by one of the two release levers 72, 73. But if the watch is adjusted counterclockwise, the torque acts against the direction of rotation of the wheels in the second transmission chain 30, 60 of the switching gear train, which would rotate the entire gear backwards, which could cause damage in the release mechanism. In order to prevent this, the disk setting means preferably has a special device which blocks the intermediate wheel pinion 86 when the watch is set in the counterclockwise direction. This blocking device comprises a stop lever rocker 91 which is pivotable by the coupling pinion lever 79 and on each of the two free ends of which is mounted a pin 92, 96, a stop spring 93 chargeable by the stop lever rocker 91 on the balance of the watch, and a blocking lever 94 movably mounted and displaceable by the stop lever rocker 91, wherein a toothing 95 of the blocking lever 94, depending on its position, engages with the teeth of the intermediate wheel pinion 86 and, as shown in FIG. 12*a*, blocks or, as shown in FIG. 12*b*, releases the latter. If, as described above, the winding stem 77 is pulled out and all parts are moved accordingly, the stop lever rocker 91 is additionally set in rotary motion, in case of the presence of the blocking device, via the coupling pinion lever 79. As a result of this movement of the stop lever rocker 91, the stop spring 93 is bent against the balance by means of the pin 92 which is visible in FIG. 11 and pressed fitted into one of its free ends, such that the balance is stopped. At the same time, the pin 96 pressed fitted into the opposite free end of the stop lever rocker 91 causes, upon movement of the stop lever rocker 91, a linear displacement of the movably mounted blocking lever 94 that is hinged to said pin 96. The linear path of the blocking lever 94 is designed such that its fine toothing 95 engages with the teeth of the intermediate wheel pinion 86 and blocks the latter against any further rotation, such that the second transmission chain 30, 60 of the switching gear train can only minimally rotate when the winding stem 77 is rotated in reverse direction. On the other hand, if the stop lever rocker 91 is located in its normal, not displaced position, both the balance as well as the intermediate wheel pinion 86 are freely pivotable, respectively rotatable. At this point it should be noted that the configuration of the blocking lever 94 can be adapted according to the force ratios and the blocking lever 94, for example, may only comprise, as shown in FIG. 12*c*, a projection or, as shown in FIG. 12*d*, an elastic leaf spring without toothing, which rests on the teeth of the intermediate wheel pinion 86 in the blocking position of the blocking device.

Figure 13:
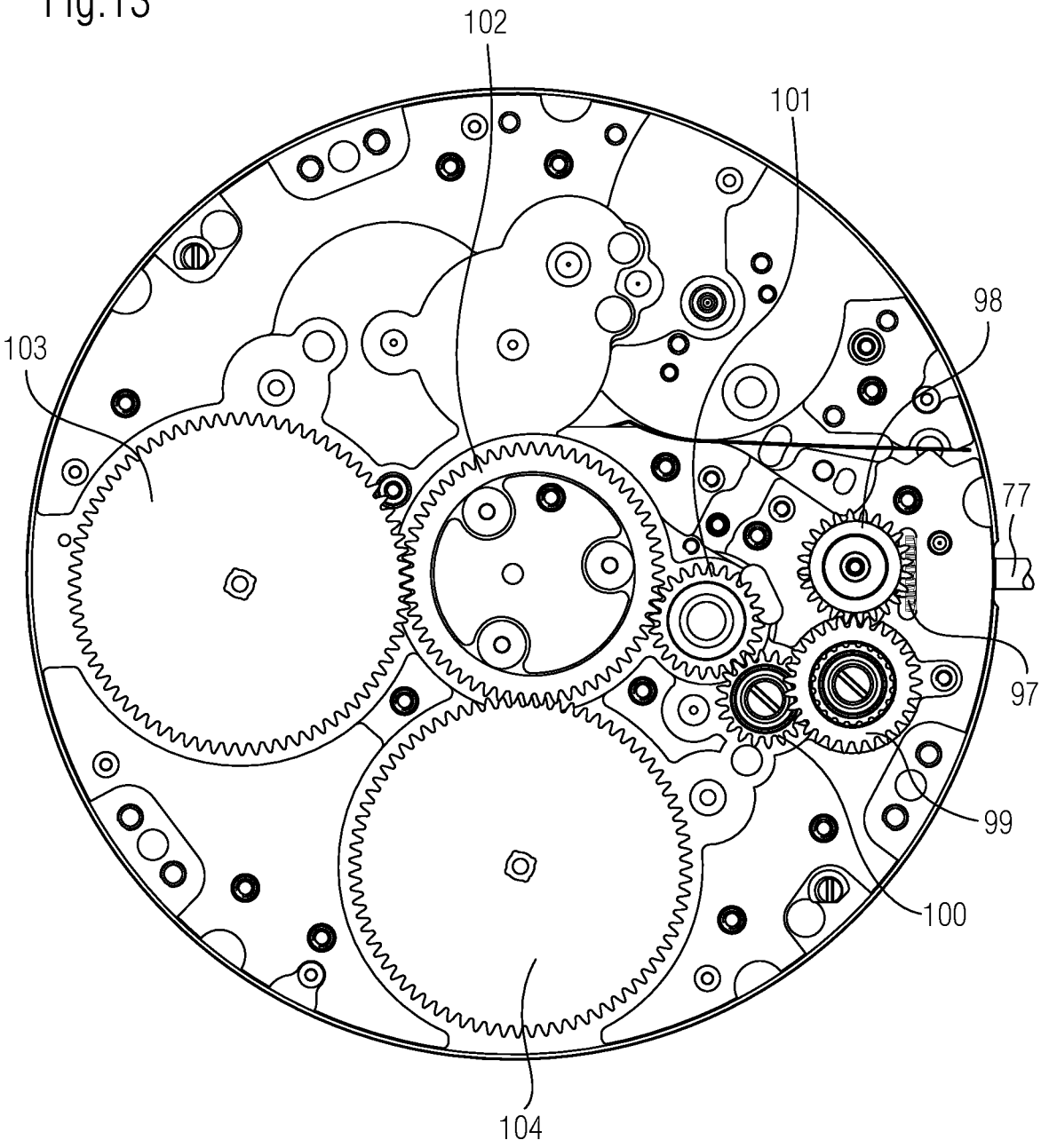
Figure 14A:
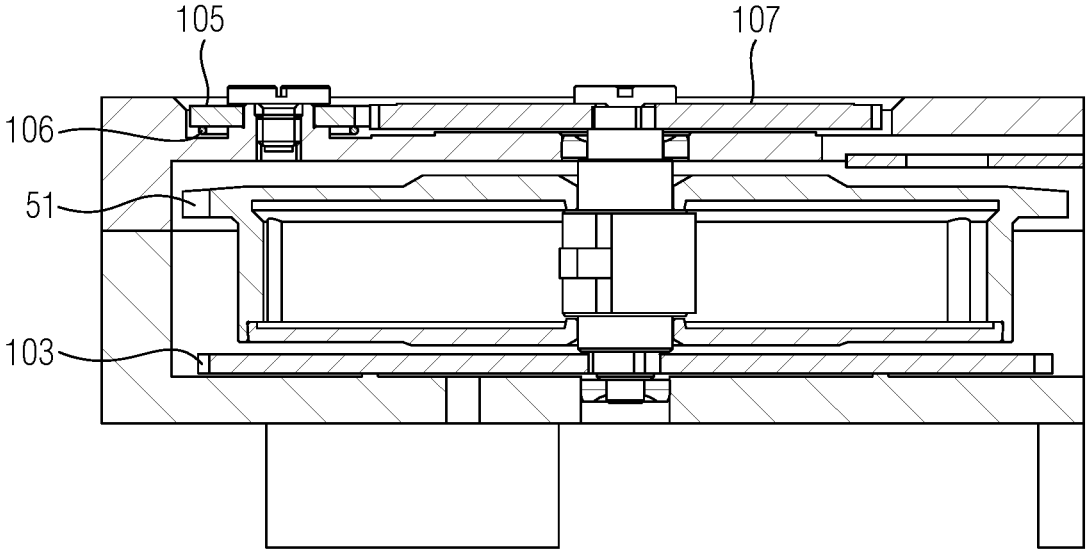
Figure 14B:
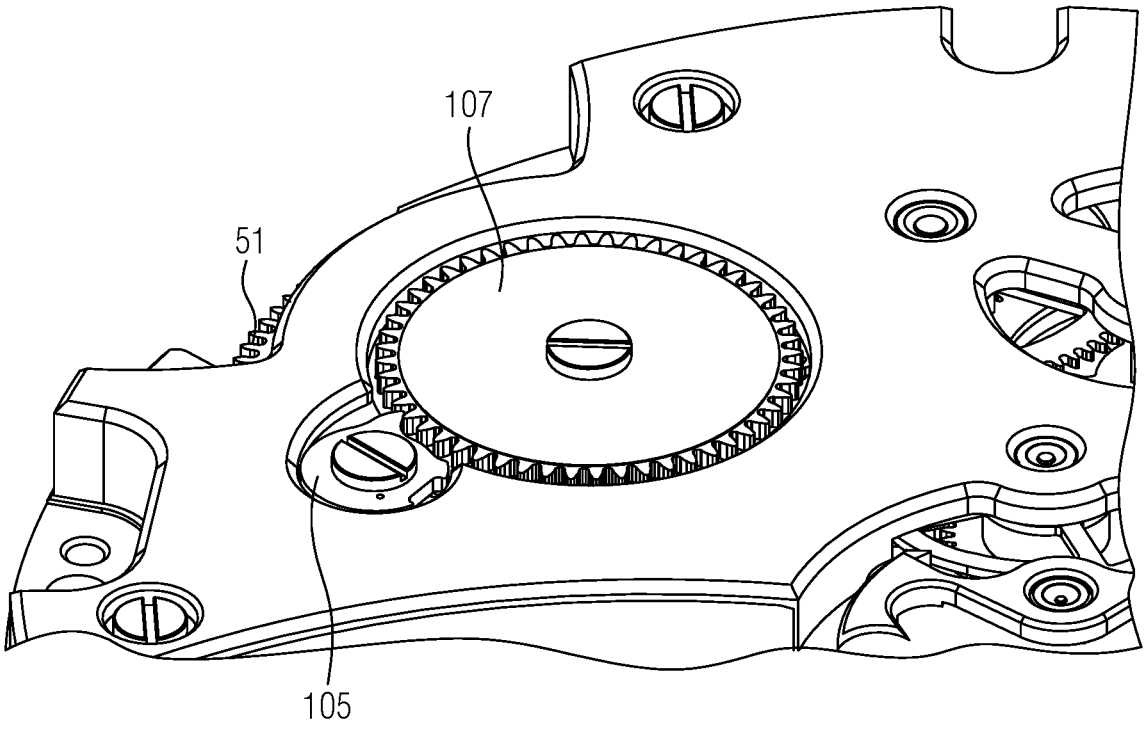

After explaining the structure of the disk setting means, the winding of the barrels 21, 31, 51, 61 shall be explained in the following, for completeness of the description of the present invention, by means of illustrations 13, 14*a* and 14*b*. The two barrels 21, 31, respectively 51, 61 of the driving gear train and the switching gear train of the movement are wound up as follows. By rotating the winding stem 77 in its non-pulled position, the coupling pinion 80 is driven by a square of the winding stem 77, wherein the coupling pinion 80 transmits this rotational movement via its locking teeth onto the winding pinion 97. As a result, as shown schematically in FIG. 13, all the other, serially intermeshing winding wheels 98, 99, 100, 101, 102, 103, 104 also rotate, wherein the two winding wheels 103 and 104 are connected by means of positive engagement with the barrels 21, 31, 51, 61. The manual winding only has one pawl 105, which is rotated by a spring 106 against a ratchet wheel 107, as can be seen in FIGS. 14*a* and 14*b*. The pawl 105 prevents the first barrel 21, 51 from winding down again, whereby the second barrel 31, 61, since it is connected via the winding wheels 102, 103, 104 to the barrel 21, 51, is also blocked via the pawl 105.

The barrels 21, 31, 51, 61 are preferably designed such that they run, even in the case of an identical length of the balance or tension springs in the first 21, 51 and the second barrel 31, 61, at different speeds and therefore do not have the same rotary speed, in particular such that the second barrel 31, 61 has a lower rotary speed than the first barrel 21, 51. This ensures that there is always enough force present on the second barrel 31, 61 to switch the display numeric disks 11, 12, 13 of the digital display 10 until the watch has reached its power reserve. In order to allow that the watch, respectively the barrels 21, 31, 51, 61, can always be fully wound up, it has two winding springs with a sliding clamp known to those skilled in the art. Optionally, the first barrel 21, 51 can also be provided with a balance or tension spring with a fixed stop for a manual winding.

Finally, it should be expressly pointed out at this point that the above-described two embodiments can be easily simplified by a specialist skilled in watchmaking so that instead of a first 21, 51 and a second barrel 31, 61, that are each used as its own source of energy for the driving gear train, respectively the switching gear train, only a single barrel is used, which serves as the sole source of energy for the entire train of the thus simplified movement. The resulting third and fourth embodiment of a movement according to the invention, which, according to the description above, have a release mechanism controlled either by means of a step disk 41 mounted on the minute wheel 22 or by means of a cam disk 71 mounted on the intermediate wheel 54 additionally inserted into the gear train, therefore, in view of the above description, don't require any further explanations and are not shown in the accompanying drawings, without this affecting the scope of the present invention also including these embodiments.

A watch according to the present invention has a number of advantages. The release mechanism of a movement according to the invention consists, in particular, only of a control disk, two release levers, each with a first and a second lever arm, and a release wheel, wherein the control disk is mounted on an intermediate pinion which is additionally integrated into the first transmission chain, this resulting in a simple and space-saving design as well as in a safe functioning. In the case of the preferred use of two barrels in the movement, these ensure a safe stepwise switching until the end of the power reserve of the timepiece, wherein the release mechanism realizes a safe control of the switching gear train by the driving gear train. Any amplitude fluctuations in the balance-spring system are thereby kept low. The associated disk setting means, which has a simply designed coupling between the intermediate wheel pinion and the minute-units disk, allows safe adjustment of the time in both directions and can be optionally equipped with a blocking device of the intermediate wheel pinion, which blocks said intermediate wheel pinion when setting the time in the counterclockwise direction. Furthermore, the winding device is robust, can be implemented in a relatively simple manner, and is characterized by a safe operation. The arrangement of the axes of the minute-units and minute-tens disk parallel to each other and inside the hour ring realizes an aesthetically pleasing, digital time display for mechanical timepieces and grants a certain degree of freedom in the arrangement of the time display on the dial of the timepiece.

LIST OF REFERENCE NUMBERS

| No. | Component |
|---|---|
| 10 | digital display |
| 11 | minute-units disk |
| 12 | minute-tens disk |

-continued

| No. | Component |
|---|---|
| 13 | hour ring |
| 14 | Maltese intermediate wheel |
| 15 | roller (on minute-units disk) |
| 16 | pin (in minute-tens disk) |
| 17 | rollers (on Maltese intermediate wheel) |
| 18 | locking radii on the Maltese contours |
| 20 | first transmission chain (driving gear train) |
| 21 | first barrel (driving gear train) |
| 22 | minute wheel |
| 23 | third wheel |
| 24 | fourth wheel |
| 25 | escapement |
| 26 | balance-spring system |
| 30 | second transmission chain (switching gear train) |
| 31 | second barrel (switching gear train) |
| 36 | minute-units wheel |
| 40 | release mechanism |
| 41 | step disk (on minute wheel) |
| 42 | release levers |
| 43 | |
| 44 | release wheel |
| 45 | eccentric |
| 46 | release springs (torsion spring) |
| 50 | first transmission chain (driving gear train) |
| 51 | first barrel (driving gear train) |
| 52 | centre wheel |
| 53 | third wheel |
| 54 | intermediate pinion |
| 55 | third additional wheel |
| 56 | fourth wheel |
| 60 | second transmission chain (switching gear train) |
| 61 | second barrel (switching gear train) |
| 66 | minute-units wheel |
| 70 | release mechanism |
| 71 | cam disk (on intermediate pinion) |
| 72 | release levers |
| 73 | |
| 74 | release wheel |
| 75 | eccentric |
| 76 | release spring (tension spring) |
| 77 | winding shaft |
| 78 | angle lever |
| 79 | coupling pinion lever |
| 80 | coupling pinion |
| 81 | setting wheel |
| 82 | setting wheel |
| 83 | setting wheel |
| 84 | setting wheel |
| 85 | setting wheel (fastened to minute-units disk) |
| 86 | intermediate wheel pinion |
| 87 | star |
| 88 | detent spring |
| 89 | eccentric |
| 90 | screw |
| 91 | stop lever rocker |
| 92 | pin (for stop spring of the balance) |
| 93 | stop spring |
| 94 | blocking lever |
| 95 | teeth of the blocking lever |
| 96 | pin (for blocking lever) |
| 97 | winding pinion |
| 98-102 | winding wheel |
| 103 | winding wheel (under barrel 51) |
| 104 | winding wheel (under barrel 61) |
| 105 | pawl |
| 106 | spring (for pawl) |
| 107 | ratchet wheel |

The invention claimed is:

1. A wristwatch timepiece comprising:

a minute-units disk;

a minute-tens disk;

an hour ring;

a movement having a balance-spring system and a gear train, by means of which a minute-units wheel of the minute-units disk is advanced rotatably in cyclic steps with ten steps per revolution;

a switching device, by means of which the minute-tens disk is advanced rotatably with six steps per revolution, wherein the hour ring during one revolution of the minute-tens disk is advanced rotatably by the minute-tens disk with twelve steps per revolution; and a manually actuatable disk setting mechanism;

wherein the movement comprises a first barrel, a first transmission chain and a second transmission chain, and wherein both of the first and the second transmission chains are connected to a release mechanism, and the first transmission chain controls the second transmission chain by means of the release mechanism such that the second transmission chain transmits every minute, clocked via the balance-spring system of the movement, a force in the form of a rotational movement to the minute-units wheel;

wherein the release mechanism comprises a control disk and two release levers, each of the two release levers having a first lever arm and a second lever arm, and a release wheel, and wherein the first lever arms of the two release levers are positioned in a shifted manner and bear with pressure on a circumference of the control disk such that, after an end of every minute, a first lever arm of one of the two release levers falls from an edge of the control disk into a recess of the control disk and a second lever arm of the one of the two release levers releases the release wheel of the release mechanism, such that the second transmission chain rotates freely until a tooth of the release wheel strikes against the second lever arm of the other one of the two release levers, thus allowing the minute-units wheel and the minute-units disk to rotate by one step, and wherein the first transmission chain comprises a center wheel driven by the first barrel, a third wheel driven by the center wheel, and an intermediate pinion meshing with the third wheel, and wherein the control disk is fastened to an axis of the intermediate pinion.

2. The timepiece according to claim 1, wherein the control disk is configured as a cam disk, and the first transmission chain comprises a third additional wheel mounted loosely and freely rotatable on a third wheel pinion attached fixedly to the third wheel, the third additional wheel engaging with the intermediate pinion, as well as a fourth wheel driven by the third additional wheel.

3. The timepiece according to claim 2, wherein the intermediate pinion is arranged laterally on a circumference of the third wheel and of the third additional wheel for the purpose of transmitting the torque from the third wheel to the third additional wheel.

4. The timepiece according to one of claim 2, wherein division of the sections of the cam disk is carried out asymmetrically.

5. The timepiece according to claim 1, wherein the release levers are arranged coaxially on a shaft serving as a pivot axis, wherein one of the release levers is fixedly attached to the shaft and the other release lever is mounted loosely on the shaft and is secured axially with a bushing.

6. The timepiece according to claim 1, wherein an eccentric is provided for each release lever, which, at the end of the releasing operation, prevents striking of these release levers on the bottom of the recesses of the control disk.

7. The timepiece according to claim 1, wherein the first and second lever arms of the release levers are designed as short and long lever arms, which are each equal in length on both release levers.

8. The timepiece according to claim 1, wherein the timepiece comprises only a single source of energy in the form of the first barrel, which supplies energy to both the first transmission chain and the second transmission chain.

9. The timepiece according to claim 1, further comprising a second barrel, wherein the first barrel supplies energy to the first transmission chain and forms a driving gear train with the first transmission chain, and the second barrel supplies energy to the second transmission chain and forms a switching gear train with the second transmission chain.

10. The timepiece according to claim 1, wherein the manually actuatable disk setting mechanism comprises a plurality of setting wheels respectively serially meshing with each other which are movable by a winding stem in its pulled-out position by a coupling pinion, wherein the last setting wheel is fixedly attached to the minute-units disk and the assembly consisting of the last setting wheel and the minute-units disk is arranged loosely and freely rotatable on an intermediate wheel pinion, which is part of the second transmission chain.

11. The timepiece according to claim 10, wherein a star gear is arranged coaxially in fixed manner to the intermediate wheel pinion and a conjugately shaped detent spring is mounted on the minute-units disk to allow alignment of the minute-units disk in a window of the dial of the timepiece as well as, in the presence of a higher force than the detent spring force, to allow a stepwise coupling and decoupling between the intermediate wheel pinion and the minute-units disk.

12. The timepiece according to claim 10, further comprising a blocking device of the intermediate wheel pinion, which blocks said intermediate wheel pinion when setting the time counterclockwise.

13. The timepiece according to claim 12, wherein the blocking device comprises a stop lever rocker which can be pivoted by a coupling pinion lever and at each of the two free ends of which is mounted a pin, a stop spring chargeable by the stop lever rocker on the balance the timepiece, as well as a blocking lever movably mounted and slidable by the stop lever rocker, wherein the blocking lever, depending on its position, engages with the teeth of the intermediate wheel pinion, respectively charges the intermediate wheel pinion, and thereby blocks or releases the intermediate wheel pinion.

14. The timepiece of claim 1, further comprising a digital display.

* * * * *